US007208252B2

(12) United States Patent
Grande et al.

(10) Patent No.: US 7,208,252 B2
(45) Date of Patent: Apr. 24, 2007

(54) MAGNETIC TONER AND CONDUCTIVE DEVELOPER COMPOSITIONS

(75) Inventors: Michael L. Grande, Palmyra, NY (US); William H. Hollenbaugh, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 377 days.

(21) Appl. No.: 10/879,117

(22) Filed: Jun. 30, 2004

(65) Prior Publication Data

US 2006/0003244 A1 Jan. 5, 2006

(51) Int. Cl.
*G03G 9/083* (2006.01)

(52) U.S. Cl. ..... 430/106.2; 430/108.8; 430/108.7; 430/108.6; 430/106.1; 430/120; 430/124

(58) Field of Classification Search ..... 430/106.1, 430/106.2, 108.6, 108.7, 124, 120, 109.4
See application file for complete search history.

(56) References Cited

U.S. PATENT DOCUMENTS

| | | | | |
|---|---|---|---|---|
| 3,467,634 | A | 9/1969 | Jacknow et al. | |
| 3,526,533 | A | 9/1970 | Jacknow et al. | |
| 5,368,970 | A | 11/1994 | Grushkin | |
| 5,506,083 | A | 4/1996 | Nash et al. | |
| 5,516,614 | A * | 5/1996 | Nash et al. | 430/108.3 |
| 5,569,572 | A * | 10/1996 | Laing et al. | 430/137.22 |
| 5,890,042 | A | 3/1999 | Wong et al. | |
| H1889 | H * | 10/2000 | Lin et al. | 430/108.8 |
| 6,194,117 | B1 | 2/2001 | Smith et al. | |
| 6,236,816 | B1 | 5/2001 | Warbus et al. | |
| 6,379,856 | B2 | 4/2002 | Sokol et al. | |
| 6,391,509 | B1 | 5/2002 | Drappel et al. | |
| 6,511,780 | B1 | 1/2003 | Veregin et al. | |
| 6,610,451 | B2 | 8/2003 | Jadwin et al. | |
| 6,610,452 | B2 | 8/2003 | Combes et al. | |
| 2003/0190541 | A1 | 10/2003 | Jadwin et al. | |
| 2004/0219448 | A1 * | 11/2004 | Kato et al. | 430/108.6 |
| 2005/0250030 | A1 * | 11/2005 | McStravick et al. | 430/108.6 |

OTHER PUBLICATIONS

"Special hydrophobic AEROSIL® (SHA) for Toners", Technical Information Tl 1222, Nippon Aerosil Co., Ltd., p. 5.*
Diamond, Arthur S & David Weiss (eds.) Handbook of Imaging Materials. New York: Marcel-Dekker, Inc. (Nov. 2001) p. 180.*

* cited by examiner

*Primary Examiner*—Christopher Rodee
(74) *Attorney, Agent, or Firm*—Oliff & Berridge, PLC

(57) ABSTRACT

Magnetic toner compositions, conductive developer compositions, and methods for producing images in a hybrid jumping development system, more specifically, in a magnetic ink character recognition system, are disclosed. The developer compositions contain coated magnetic toner particles and coated carrier particles. The toner compositions include a resin, colorant, wax, magnetic component, and surface additives of coated silica, titania, and zinc stearate.

24 Claims, No Drawings

MAGNETIC TONER AND CONDUCTIVE DEVELOPER COMPOSITIONS

BACKGROUND OF THE INVENTION

1. Field of Invention

This invention is generally directed to toner and developer compositions that can be used in hybrid jumping development systems, including, but not limited to, magnetic image character recognition systems.

2. Description of Related Art

There are many known electrostatographic processes for recording an image, wherein an electrostatic latent image is formed on a charge retentive surface, such as a photoreceptor, developed with toner, and transferred to a recording medium, such as paper. The toner-based image is generally fixed to the recording medium by any suitable process, such as heating, applying pressure, treating with a solvent vapor, or a combination thereof.

Toners, and developers comprising the toners, used in electrostatographic processes have well-known, standard compositions. For example, in a type of electrostatographic system known as hybrid jumping development (HJD), the developer is generally a standard, two-component conductive developer comprising standard toner particles that adhere to triboelectrically-charged carrier particles.

In HJD systems, the toner particles are loaded onto a donor roll (or development roll) and a "toner cloud" is formed when the toner particles are transported to the development zone (or "development nip") formed by a charge retentive surface and the donor roll. Transportation to the development zone is powered by applying alternating potentials to the donor role from two development fields (potentials across an air gap), such that the toner particles "jump" from the donor roll to the charge retentive surface. In other words, the toner particles are sufficiently attracted to the electrostatic latent image on the charge retentive surface, such that they disassociate from the carrier particles to form the toner-based image. The resulting toner-based image is then transferred from the charge retentive surface to any suitable recording medium and optionally heated to permanently affix the toner-based image to the recording medium. A description of hybrid jumping development systems is set forth in U.S. Pat. No. 5,890,042, for example, incorporated by reference herein in its entirety.

Regarding the two development fields in HJD systems, generally, the first field, the A/C jumping field used for the toner cloud generation, has a typical potential of about 2.6 k volts peak to peak at about 3.25 kHz frequency, for example, and the second field, the D/C development field, is used to control the amount of developed toner mass on the charge retentive surface.

Although standard HJD systems and other known, standard systems, use standard toner and developer, in specialized electrostatographic processes, including specialized HJD-based processes and other specialized processes, standard toners and developers do not function effectively due to the highly specific needs of the specialized process. A specific example of such a specialized process is the process used in the magnetic image character recognition (MICR) imaging and printing system, which relies on a high speed reading and sorting process to print checks and other financial documents. MICR systems must maintain consistent signal strength, uniformity from document to document, and image permanence in high-speed readers/sorters. To meet at least these requirements, MICR systems employ conductive developers comprising magnetically readable toner.

Although magnetic toners in general are known, they suffer from serious disadvantages. For example, magnetic toners contain a heavy loading of ferromagnetic particles, such as, for example, iron oxide or other magnetic material, which is needed to produce the requisite magnetic signal strength. However, toners having a heavy loading of iron oxide are difficult to manufacture since an adequate dispersion of the iron oxide particles in the toner resin, for example, is hard to achieve and then maintain once achieved. Furthermore, due to decreased fusing efficiencies resulting from the heavy magnetic loading, the image quality obtained with known magnetic toners is low compared to the image quality obtained with standard toners in non-MICR processes.

Thus, it would be desirable to provide magnetic toner compositions that have the benefits of non-magnetic toners, such as, for example, image quality and ease of production, yet have the capability of use in HJD-based systems and MICR systems. In other words, it would be desirable to provide electrostatographic toners that produce high quality images and can be used in standard banking reader/sorter equipment, i.e., MICR equipment.

Moreover, it would be desirable to provide highly conductive developer compositions capable of use in HJD-based systems and MICR systems.

SUMMARY OF THE INVENTION

The present invention relates to methods for developing images, such as, for example, electrostatic images, using magnetic toners. In a preferred embodiment, the methods comprise developing an electrostatic image in a HJD-based system. In a more preferred embodiment, the HJD-based system is a MICR system.

The present invention further relates to highly conductive developer compositions comprising at least two components—magnetic toner particles and coated carrier particles. In a preferred embodiment, the magnetic toner particles of the present invention are surface treated and charged causing them to adhere to coated carrier particles having the opposite charge. However, the toner particles are also able to dissociate from the carrier particles due to the electrostatic and/or mechanical forces of the electrostatic image on the charge retentive surface, and due to the surface treatment of the magnetic toner particles. Thus, the present invention further relates to magnetic toner particles having a surface treatment.

The present invention further relates to printers and printing systems comprising HJD technology, preferably, MICR technology, and/or employing the highly conductive developer compositions and magnetic toner compositions described herein.

In one embodiment of the invention, the magnetic toner compositions comprise a binder, a colorant, a magnetic component, polypropylene wax, polyethylene wax, and a wax that functions as a wax compatibilizer, wherein the toner particles are surface treated with a coating composition comprising at least a first, second, and third type of silica particles, titania particles, and a metal salt of a fatty acid, wherein one type of silica particle is characterized by ultra-large size particles, one type of silica is characterized by large-size particles, and one type of silica is characterized by small-size particles.

In a preferred embodiment of the invention, the coating on the inventive toner particles comprises amorphous silica particles of about 30 to about 50 nm in median diameter coated with a siloxane coating, amorphous silica particles of about 9 to about 15 nm in median diameter coated with a silane coating, sol-gel silica particles of about 80 to about 140 nm in median diameter, titania particles coated with a decyltrimethoxysilane coating, and a metal salt of a fatty acid.

In a more preferred embodiment of the invention, the coating on the inventive toner particles comprises amorphous silica particles of about 40 nm in median diameter coated with a polydimethylsiloxane coating, amorphous silica particles about 12 nm in median diameter coated with an octyltrimethoxysilane coating, sol-gel silica particles of about 110 nm in median diameter, titania particles of about 40 nm in median diameter coated with a decyltrimethoxysilane coating, and zinc stearate.

In another embodiment of the invention, the conductive developers comprise the magnetic toner particles comprising a binder, a colorant, a magnetic component, polypropylene wax, polyethylene wax, and a wax that functions as a wax compatibilizer, wherein the toner particles are surface treated with a composition comprising at least a first, second, and third type of silica particles, titania particles, and a metal salt of a fatty acid, wherein one type of silica particle is characterized by ultra-large size particles, one type of silica is characterized by large-size particles, and one type of silica is characterized by small-size particles; and coated carrier particles.

In a preferred embodiment of the invention, the coated carrier particles are positively charged carrier particles comprising a metal core, such as, for example, steel, coated with a conductive polymer coating comprising, for example, polypyrrole, polyaniline, and carbon black.

Another embodiment of the invention is directed to methods of obtaining images in a magnetic image recognition system comprising generating an electrostatic latent image on a charge retentive surface, developing the image with an inventive developer composition, and transferring the image to a recording medium. In a preferred embodiment, the image is subsequently permanently affixed to the medium.

These and other features and advantages of this invention are described in, or are apparent from, the following detailed description of various exemplary embodiments of the systems and methods according to this invention.

DETAILED DESCRIPTION OF PREFERRED EMBODIMENTS

The inventive toner and developer compositions described herein are capable of use in HJD-based systems and MICR imaging and printing systems. Thus, in one embodiment of the invention, conductive developer compositions are provided, which comprise, at least, surface treated magnetic toner particles and coated carrier particles.

In a preferred embodiment of the invention, the magnetic toner particles comprise: at least two waxes to enable fusing performance of the toner, reduce offset, and minimize smearing of the image; at least one wax that functions as a wax compatibilizer to enable good wax incorporation, and thus good wax dispersion in the toner; at least one colorant to provide color to the toner; at least one magnetic component to provide the requisite magnetic characteristic to the toner; and at least one resin (also known as a binder).

In another preferred embodiment of the invention, each magnetic toner particle is coated via surface treatment with a composition comprising: at least three different types of silica, wherein one type of silica particle is characterized by ultra-large size particles, one type of silica is characterized by large-size particles, and one type of silica is characterized by small-size particles; coated titania particles; and coated zinc stearate particles, which provide lubrication and conductivity to the final toner, and thus developer, composition. The silica particles and titania particles provide triboelectric charging stability and render the toner particles less sensitive to environmental change.

The inventive magnetic toner compositions can be prepared by any known process, such as, for example, melt-mix extrusion, so long as the resulting toner particles have a median volume diameter of about 8 to about 10 μm, more preferably, about 9 μm.

More specifically, the magnetic toner compositions of the present invention can be prepared by, for example, a method comprising: (1) mixing and heating the resin, colorant, wax, magnetic component, and charge enhancing additives, if any, such as, for example, coated alumina particles, or other charge enhancing additives well known in the art, in a toner extrusion device to form pellets; (2) removing the formed toner pellets from the extruder; (3) cooling the toner pellets; (4) grinding the toner pellets into particles to obtain the desired median volume diameter; and (5) coating the toner particles with external additives to obtain the final toner composition.

Toner Particle Components

Resin

The toner particles comprise a resin that is, preferably, a partially cross-linked resin, as described in U.S. Pat. Nos. 5,368,970 and 5,506,083, incorporated by reference herein in their entirety.

Suitable toner resins include, but are not limited to, thermoplastic resins, such as, for example, vinyl resins, styrene resins, and polyesters. Specific suitable thermoplastic resins include, but are not limited to, styrene methacrylates; polyolefins; styrene acrylates; styrene butadienes; epoxies; polyurethanes; homopolymers or copolymers of two or more vinyl monomers; polymeric esterification products of a dicarboxylic acid and a diol comprising a diphenol; p-chlorostyrene; unsaturated mono-olefins, such as, for example, ethylene, propylene, butylene, and isobutylene; saturated mono-olefins, such as, for example, vinyl acetate, vinyl propionate, and vinyl butyrate; vinyl esters, such as, for example, esters of monocarboxylic acids including, but not limited to, methylacrylate, ethylacrylate, n-butylacrylate, isobutylacrylate, dodecylacrylate, n-octylacrylate, phenylacrylate, methylmethacrylate, ethylmethacrylate, and butylmethacrylate; acrylonitrile and methacrylonitrile; acrylamide; and mixtures thereof.

In embodiments, the resin is a partially cross-linked polyester resin present in any effective amount. More preferably, the resin is a partially cross-linked polyester resin present in a concentration of about 50% to about 70% by weight of the toner composition, even more preferably, about 60.5% by weight of the toner composition.

Magnetic Component

Other than the resin, the toner component in the largest concentration, by weight, is the magnetic component, which provides the toner with its magnetic properties.

The magnetic component can be any magnetic material that enables the toner to render a permanently magnetized image consistent with the requirements of a MICR system. Preferable magnetic components include, but are not limited to, iron oxides and mixtures thereof, such as, for example, FeO, $Fe_2O_3$, and magnetite ($Fe^{2+}Fe^{3+}{}_2O_4$) in any arrangement, e.g., octahedral, spherical, or acicular. Preferred, commercially available magnetites include, but are not limited to, Magnox B353 (Magnox, Inc., Wilmington, Del.) and Mapico Black (Mapico, Inc., LeMay, Mo.).

In embodiments, the magnetic component is a magnetite and is present in any effective amount. More preferably, the magnetic component is a magnetite and is present in a concentration of about 18% to about 24% by weight of the toner composition, even more preferably, about 21% by weight of the toner composition.

Wax

The toner composition comprises at least two waxes and a third wax that functions as a wax compatibilizer.

The first wax is a polypropylene wax preferably having a molecular weight ranging from about 6000 to about 11000 Mw. Preferably, the polypropylene wax has a high melt flow index sufficient to enable adequate fusing of the toner, which reduces offset, and to release the toner, such that toner sticking is avoided or, at least, minimized.

In embodiments, the polypropylene wax is the commercially available wax 660P (Sanyo Chemical Industries, Ltd., Kyoto, Japan), present in any effective amount. More preferably, the polypropylene wax is present in a concentration of about 4% to about 6% by weight of the toner composition, even more preferably, about 5% by weight of the toner composition.

The second wax is a polyethylene wax preferably having a molecular weight ranging from about 1800–2200 Mw, and having the ability to provide image durability by, for example, minimizing image smearing on the printed documents and to provide reader/sorter durability.

In embodiments, the polyethylene wax is a crystalline polyethylene wax, such as, for example, commercially available Polywax®-2000 (PW-2000) (Baker-Hughes, Inc., Houston, Tex.), present in any effective amount. More preferably, the crystalline polyethylene wax is present in a concentration of about 4.5% to about 6.5% by weight of the toner composition, even more preferably, about 5.5% by weight of the toner composition.

The third wax component is preferably an epoxy modified polyolefin wax that functions as a wax compatibilizer to enable good wax incorporation into the toner particle, thus improving wax dispersion therein, as described in U.S. Pat. No. 5,368,970, for example, incorporated by reference herein in its entirety.

In embodiments, the wax compatibilizer is a copolymer of ethylene-methyl acrylate and glycidylmethacrylate, such as, for example, commercially available Lotader® AX 8950 (Atofina, Philadelphia, Pa.), present in any effective amount. More preferably, the wax compatibilizer is a copolymer and is present in a concentration of about 4% to about 6% by weight of the toner composition, even more preferably, about 5% by weight of the toner composition.

Colorant

In order to provide color to the printed documents, the toner particles contain at least one colorant. The colorant can be at least one dye, at least one pigment, or mixtures thereof. Colorants include, but are not limited to, those well known in the art, such as, for example, black, cyan, magenta, yellow, red, green, brown, or blue colorants or mixtures thereof. Preferably, the colorant is black. Preferred black colorants include, but are not limited to, carbon black and other amorphous carbon colorants, such as, for example, the commercially available gloss ink pigment black Regal 330 or Regal 330R (Cabot Corp., Boston, Mass.).

In embodiments, the colorant is carbon black present in any effective amount. More preferably, the colorant is carbon black present in a concentration of about 2.5% to about 3.5% by weight of the toner composition, even more preferably, about 3% by weight of the toner composition.

External Additives

Surface treating the toner particles with external additives, such as, for example, a spacing agent, can reduce the attraction between the toner particles and the carrier particles of the developer sufficiently such that the magnetic toner particles are transported by the carrier particles to the development zone where the electrostatic image is present, and then the magnetic toner particles separate from the carrier particles due, at least in part, to the electrostatic forces associated with the charged image. Accordingly, the preferred magnetic toner particles of the present invention adhere to the carrier particles, yet separate therefrom in response to electrostatic and/or mechanical forces. The surface treatment with the external additives described below provides this combination of adherence and separation.

In embodiments, external additives include, but are not limited to, titania particles, metal salts of fatty acids, and at least three types of silica particles having different particle sizes, wherein one type has a large median diameter, i.e., about 25 to about 60 nm, one type has a small median diameter, i.e., about 5 to about 20 μm, and one type has an ultra-large median diameter, i.e., about 50 to about 200 nm.

More specifically, the external additives preferably comprise: (1) large amorphous silica particles ($SiO_2$) of about 30 to about 50 nm median diameter, preferably, about 40 nm median diameter, coated with a siloxane coating, including, but not limited to, aminopolysiloxane, such as, for example, gamma-aminotrimethoxy or trimethylsilane, hexamethyldisilazane, and polydimethylsiloxane, which are used in triboelectric charging adjustment and control, for example; (2) small amorphous silica particles ($SiO_2$) of about 9 nm to about 15 nm median diameter, preferably about 12 nm median diameter, coated with a silane coating, such as, for example, octyltrimethoxysilane, which are used in triboelectric charging adjustment and control, for example; (3) ultra-large silica particles ($SiO_2$), such as, for example, sol-gel silica particles, of about 80 nm to about 140 nm median diameter, preferably, about 110 nm median diameter, which are used as spacers to minimize filming, for example; (4) titania ($TiO_2$) particles of about 30 nm to about 50 nm median diameter, preferably about 40 nm median diameter, coated with a silane coating, such as, for example, a decylsilane, such as, for example, decyltrimethoxysilane, which provide triboelectric charging and protect other additives, for example; and (5) at least one metal salt of a fatty acid, such as, for example, calcium stearate, magnesium stearate, or zinc stearate ($Zn(C_{18}H_{36}O_2)_2$), which provides conductivity and triboelectric charging and functions as a lubricant, for example.

In embodiments, the silica particles in the first group are fumed silica particles, such as, for example, commercially available RY-50 particles (Nippon Aerosil Co., Ltd., Tokyo, Japan).

In embodiments, the silica particles in the second group are fumed silica particles, such as, for example, commercially available Aerosil® 300 particles (Degussa Aktiengesellschaft, Frankfurt, Germany), which have silanol groups present on the particle surface.

In embodiments, the silica particles in the third group are ultra-large silica particles, such as, for example, sol-gel particles including, but not limited to, commercially available X-24-9163A particles (ShinEtsu Chemical Co., Ltd., Tokyo, Japan), which are coated with octylsilane groups.

In embodiments, the titania particles are the commercially available SMT-5103 particles (Tayca, Inc., Osaka, Japan), and preferably the metal salt of a fatty acid is zinc stearate.

The external additives can be applied to the surface of the magnetic toner particles by conventional surface treatment techniques, such as, for example, conventional mixing techniques. The external additives attached to the surface of the magnetic toner particles are attached by electrostatic forces, physical means, or a mixture thereof.

Developer Compositions

The present invention further relates to developer compositions characterized by high and stable conductivity, superior flow, high environmental stability, and triboelectric charging properties. The developer compositions comprise the coated toner compositions described herein and coated carrier particles.

Developer compositions can be obtained by mixing the inventive toner particles with suitable carrier particles, particularly those that are capable of triboelectrically assuming an opposite polarity to that of the toner particles. For example, the carrier particles can be of negative polarity to enable the toner particles, which are positively charged, to adhere to and surround the carrier particles. Preferably, the carrier particles are composed of a hard magnetic material exhibiting sufficient magnetic momentum to prevent the carrier particles from transferring to the electrostatic image despite the charge attraction between the toner particles and the carrier particles. Illustrative examples of carrier particles include, but are not limited to, steel, nickel, and iron and other ferrites, such as, for example, copper/zinc ferrites and magnetic iron oxides. Preferably, the carrier particles are steel particles.

To function effectively in MICR systems and to maintain triboelectric charge stability over a broad range of environmental conditions, the carrier particles are preferably coated with a conductive coating, as described in U.S. Pat. No. 5,516,614, for example, incorporated by reference herein in its entirety. Exemplary conductive coatings that are well known in the art include, but are not limited to, coatings comprising terpolymers of styrene, acrylate or methacrylate, and a silane, such as, for example, triethoxy silane as described in U.S. Pat. Nos. 3,526,533 and 3,467,634, incorporated by reference herein in their entirety, and other known carrier coating compositions.

Preferred carrier particle coatings are polymer-based coatings comprising a single polymer or a mixture of polymers. The polymer coating preferably contains conductive components, such as, for example, carbon black, in a concentration of ranging from about 5% to about 30% by weight of the carrier coating. More preferably, the coating comprises intrinsically conductive polymer additives based on polypyrrole and polyaniline. Even more preferably, the coating is the commercially available as Eeonomer® coating (Eeonyx Corp., Pinole, Calif.), which comprises thin layers of polypyrrole and polyaniline on the surface of carbon black components and has a conductivity of up to about 30 S/cm.

The percentage of each polymer present in the carrier coating mixture can vary depending on the specific components selected, the coating weight, and the properties desired. Generally, the coated polymer mixtures contain from about 10% to about 90% by weight of a first polymer and from about 90% to about 10% by weight of a second polymer, and, more preferably, from about 40% to about 60% by weight of the first polymer and from about 60% to about 40% by weight of the second polymer.

Coating weights can vary as known in the art. Generally, the coating is present in a concentration of about 0.1% to about 3% by weight of the carrier, more preferably, about 0.3% to about 2% by weight of the carrier, and, most preferably, about 0.4% to about 1.5% by weight of the carrier. The diameter of the carrier particles preferably permits the carrier particles to possess sufficient density and inertia to avoid adherence to the images during the development process. The preferred shape is non-spherical and the preferred median diameter is about 50 μm to about 1000 μm, more preferably, about 75 μm to about 150 μm.

The carrier component of the developer can be mixed with the toner component of the developer in various suitable combinations, such as, for example, about 3 to about 9 parts of toner particles to about 100 parts of carrier particles.

While the invention has been described in conjunction with the specific embodiments described above, it is evident that many alternatives, modifications and variations are apparent to those skilled in the art. Accordingly, the preferred embodiments of the invention set forth above are intended to be illustrative and not limiting. Various changes can be made without departing from the spirit and scope of the invention.

What is claimed is:

1. A magnetic toner composition, comprising a binder, a colorant, a magnetic component, polypropylene wax, polyethylene wax, and a wax that functions as a wax compatibilizer, wherein the toner particles are surface treated with a composition comprising at least a first, second, and third type of silica particles, titania particles, and a metal salt of a fatty acid, wherein the first type of silica particle is coated and has a median particle diameter of about 25 to about 60 nm, the second type of silica particle is coated and has a median particle diameter of about 5 to about 20 nm, and the third type of silica particle has a median particle diameter of about 80 to about 200 nm.

2. The toner composition according to claim 1, wherein the binder is a partially cross-linked polyester resin.

3. The toner composition according to claim 1, wherein the colorant is a black colorant.

4. The toner composition according to claim 1, wherein the magnetic component is magnetite.

5. The toner composition according to claim 1, wherein the wax that functions as a wax compatibilizer is a copolymer of ethylene and glycidylmethacrylate.

6. The toner composition according to claim 1, wherein the polypropylene wax has a molecular weight of about 6000 to about 11000 Mw.

7. The toner composition according to claim 1, wherein the polyethylene wax is a crystalline wax having a molecular weight of about 1800 to about 2200 Mw.

8. The toner composition according to claim 1, wherein the first type of the silica particle is amorphous silica particles of about 30 to about 50 nm in median diameter coated with a siloxane coating.

9. The toner composition according to claim 8, wherein the first type of silica particle is amorphous silica particles of about 40 nm in median diameter coated with a polydimethylsiloxane coating.

10. The toner composition according to claim 1, wherein the second type of silica particle is amorphous silica particles of about 9 to about 15 nm in median diameter coated with a silane coating.

11. The toner composition of claim 10, wherein the second type of silica particle is amorphous silica particles about 12 nm in median diameter coated with an octyltrimethoxysilane coating.

12. The toner composition of claim 1, wherein the third type of silica particle is sol-gel silica particles of about 80 to about 140 nm in median diameter.

13. The toner composition of claim 12, wherein the third type of silica particle is sol-gel silica particles of about 110 nm in median diameter.

14. The toner composition of claim 1, wherein the titania particles are about 40 nm in median diameter.

15. The toner composition of claim 14, wherein the titania particles are coated with a decyltrimethoxysilane coating.

16. The toner composition of claim 1, wherein the metal salt of a fatty acid is zinc stearate.

17. A conductive developer comprising the magnetic toner particles of claim 1 and coated carrier particles.

18. A method of obtaining images in a magnetic image recognition system, comprising generating an electrostatic latent image on a charge retentive surface, developing the image with the composition of claim 17, and transferring the image to a recording medium.

19. The method of claim 18, further comprising permanently affixing the image to the medium.

20. A conductive developer composition comprising:

negatively charged toner particles comprised of a polyester resin, a colorant, polypropylene wax, polyethylene wax, a wax that functions as a compatibilizer, and a magnetic component, wherein the particles are surface treated with at least a first, second, and third type of silica particles, titania particles, and a metal salt of a fatty acid, wherein the first type of silica particle is coated and has a median particle diameter of about 25 to about 60 nm, the second type of silica particle is coated and has a median particle diameter of about 5 to about 20 nm, and the third type of silica particle has a median particle diameter of about 80 to about 200 nm; and positively charged carrier particles comprising a metal core with a conductive polymer coating.

21. The developer composition of claim 20, wherein the carrier particle coating comprises polypyrrole, polyaniline, and carbon black.

22. The developer composition of claim 20, wherein the carrier core is steel.

23. The developer composition of claim 22, wherein the first type of the silica particle is amorphous silica particles of about 30 to about 50 nm in median diameter coated with a siloxane coating, the second type of silica particle is amorphous silica particles of about 9 to about 15 nm in median diameter coated with a silane coating, the third type of silica particle is sol-gel silica particles of about 80 to about 140 nm in median diameter, the titania particles are about 40 nm in median diameter coated with a decyltrimethoxysilane coating, and the metal salt of a fatty acid is zinc stearate.

24. The developer composition of claim 23, wherein the first type of silica particle is amorphous silica particles of about 40 nm in median diameter coated with a polydimethylsiloxane coating, the second type of silica particle is amorphous silica particles about 12 nm in median diameter coated with an octyltrimethoxysilane coating, and the third type of silica particle is sol-gel silica particles of about 110 nm in median diameter.

* * * * *